US009922780B2

(12) United States Patent
Niebler et al.

(10) Patent No.: US 9,922,780 B2
(45) Date of Patent: Mar. 20, 2018

(54) SWITCHING DEVICE HAVING AN EXCHANGEABLE SWITCHING PIECE ASSEMBLY

(71) Applicant: Siemens Aktiengesellschaft, Munich (DE)

(72) Inventors: Ludwig Niebler, Laaber (DE); Vadzim Kulinovich, Amberg (DE); Tobias Viehauser, Schwandorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/105,491

(22) PCT Filed: Dec. 18, 2013

(86) PCT No.: PCT/EP2013/077163
§ 371 (c)(1),
(2) Date: Jun. 16, 2016

(87) PCT Pub. No.: WO2015/090384
PCT Pub. Date: Jun. 25, 2015

(65) Prior Publication Data

US 2017/0004934 A1 Jan. 5, 2017

(51) Int. Cl.

| | |
|---|---|
| ***H01H 9/34*** | (2006.01) |
| ***H01H 9/44*** | (2006.01) |
| ***H01H 11/06*** | (2006.01) |
| ***H01H 50/54*** | (2006.01) |

(52) U.S. Cl.
CPC ..... *H01H 9/345* (2013.01); *H01H 50/546* (2013.01); *H01H 9/44* (2013.01); *H01H 2011/062* (2013.01)

(58) Field of Classification Search
CPC ..... H01H 9/345; H01H 9/32; H01H 9/546
USPC ..... 218/150, 156, 46; 335/201, 202
See application file for complete search history.

(56) References Cited

U.S. PATENT DOCUMENTS 2,654,815 A * 10/1953 Laverty ..... H01H 9/302 218/156
2,969,444 A 1/1961 Deissler
3,215,800 A 11/1965 Hurter et al.
(Continued)

FOREIGN PATENT DOCUMENTS

CN 1181605 5/1998
CN 101211719 7/2008
(Continued)

OTHER PUBLICATIONS

Translation of EP1422735 (Original Documnet published May 26, 2004).*
(Continued)

*Primary Examiner* — Renee Luebke
*Assistant Examiner* — William Bolton
(74) *Attorney, Agent, or Firm* — Cozen O'Connor

(57) ABSTRACT

A switching device including a switching chamber, in which a stationary switching piece is arranged opposite a movable switching piece, where the stationary switching piece is placed on a plastic carrier part and this component combination of stationary switching piece and plastic carrier part is configured as an exchangeable switching piece assembly.

9 Claims, 3 Drawing Sheets

(56) References Cited

U.S. PATENT DOCUMENTS

| | | | | | |
|---|---|---|---|---|---|
| 5,075,659 | A * | 12/1991 | Morgan | H01H 9/0072 | 335/17 |
| 6,703,575 | B1 * | 3/2004 | Yamamoto | H01H 9/342 | 218/46 |
| 7,285,742 | B2 * | 10/2007 | Kinzler | H01H 71/0207 | 218/149 |
| 7,439,469 | B2 * | 10/2008 | Gerving | H01H 9/36 | 218/38 |
| 2007/0158171 | A1 * | 7/2007 | Deboer | H01H 89/06 | 200/331 |
| 2010/0245002 | A1 * | 9/2010 | Watanabe | H01H 50/163 | 335/185 |
| 2013/0015049 | A1 * | 1/2013 | Tengler | H01H 13/28 | 200/557 |

FOREIGN PATENT DOCUMENTS

| | | | | |
|---|---|---|---|---|
| DE | 10 94 851 | | 12/1960 | |
| EP | 0 834 894 | A2 | 4/1998 | |
| EP | 1422735 | * | 5/2004 | H01H 71/02 |
| EP | 0 834 894 | B1 | 12/2005 | |

OTHER PUBLICATIONS

Office Action dated Mar. 3, 2017 which issued in the corresponding Chinese Patent Application No. 2013800809005.

* cited by examiner

SWITCHING DEVICE HAVING AN EXCHANGEABLE SWITCHING PIECE ASSEMBLY

CROSS-REFERENCE TO RELATED APPLICATIONS

This is a U.S. national stage of application No. PCT/EP2013/077163 filed 18 Dec. 2013.

BACKGROUND OF THE INVENTION

1. Field of the Invention

The invention relates to a switching device having a switching chamber, in which a stationary switching piece is arranged opposite to a moveable switching piece.

2. Description of the Related Art

Switching devices, such as heavy-duty contactors, in purely mechanical terms, are rated for a service life of 10 million switching cycles. If these contactors are used at their electrical design limit, the switching contacts will show wear far earlier, such as after 1 million switching cycles. Producers of high-cost, contactors already supply replacement switching pieces. A customer can then replace the worn switching pieces in the contactor, rather than replacing the complete high-cost contactor, thereby generating a cost saving.

However, the functionality of exchangeable switching pieces is subject to particular structural requirements. For example, arcing at the switching point, associated with a normal switching duty, results in the exceptionally high thermal loading of the switching chamber walls. Accordingly, for example, no thermoplastics can be employed in the vicinity of the switching point, as these will melt and may be damaged accordingly.

However, the use of thermoplastics for the switching chamber is a particularly attractive option, as the use of this special type of plastic permits the switching chamber to be configured with a more finely reticulated and smaller structure, thereby resulting in an overall contactor of more compact design.

Various switching devices with removable contact units are known from the prior art. EP 0 834 894 B2 discloses a switching device for an electric current, in which the switching arrangement is provided with a body of an electrically insulating material, and with a first and a second stationary contact, which are fitted to the body. The switching device is also provided with a moveable contact, which is movably coupled to the body and selectively engages with the first and second stationary contacts respectively to form an electrical connection. The switching device is also provided with an actuation arrangement incorporating a containment or a housing, which contains an electrically-actuated drive mechanism, and incorporating an element which is detachably coupled to the moveable contact, for the alternating actuation of the moveable contact such the latter is engaged with, or disengaged from the first and second stationary contacts.

Accordingly, the switching system is connected to the actuation system by a sealable arrangement, such that any arcs generated between the moveable contact and the first and second stationary contacts cannot escape from the electric current switching device, whereby the switching system is configured as an individual unit that can be detached from the actuation system for repair and replacement.

DE 1 094 851 discloses a contact device with an exchangeable contact unit is known, where the contact pieces of the electric power feed line are secured to a base unit, which is bonded to the contact unit such that, when the contact unit is removed from the base unit, it is not necessary to disconnect the power feed lines. In this arrangement, the exchangeable contact unit, which is preferably configured of a contact body with stationary contacts and an actuating element with moveable contacts, is mechanically secured to the base unit by detachable fastener that that cooperate with the contact pieces on the base unit. These fasteners simultaneously establish the electrical bonding of the contact unit with the power feed lines.

Conventional solutions have a disadvantage, in that they occupy a substantial unit volume and/or that the customer, at their own discretion, in addition to the switching pieces, is required to replace further individual components that can only be replaced by expert personnel.

SUMMARY OF THE INVENTION

It is therefore an object of the present invention to provide a switching device having a switching chamber, which permits the straightforward replacement of the switching pieces, notwithstanding the compact structure of the switching device.

This and other objects and advantages are achieved in accordance with the invention by providing a switching device in which a stationary switching piece is arranged opposite a moveable switching piece. In accordance with the invention, the stationary switching piece is fitted to a plastic carrier part, and this component combination of stationary switching piece and plastic carrier part is configured as an exchangeable switching piece assembly.

In accordance with the invention, the stationary switching piece is fitted in a switching device, preferably in a contactor, on a plastic carrier part and, in combination with the plastic carrier part, forms a switching chamber insert. It may be provided that those parts of the switching chamber which, in normal switching duty, are subject to the same influences, are molded onto the plastic carrier part.

This assembly of switching piece and plastic carrier part is configured to permit the very easy replacement thereof by the customer, who can purchase this switching chamber insert as a spare part.

The moveable switching pieces are mounted in a contact carrier, and may also be replaced together with the contact carrier. The contact carrier and the switching chamber are constructed or shielded such that they are not damaged by switching arcs. In alternative embodiments, the switching chamber insert may incorporate arc extinguishers including, for example, arc splitters or arc quenching buckets, or metal screens with various functions. Depending upon the rated service current and the rated service voltage, these arc extinguishers are required for the interruption of currents, for example, in a contactor.

In accordance with the invention, the switching chamber insert is constructed such that it contains all the wear points. As all the wear points are incorporated in a switching chamber of the chamber insert, it is not structurally necessary for other housing elements of the switching device to fulfill further requirements with respect to arcing resistance. Accordingly, there are fewer restrictions upon the selection of materials or upon the structural configuration. As a result, the switching device as a whole can be configured with a more finely reticulated structure, thereby permitting compact construction. In the switching device in accordance with the invention, with exchangeable switching piece assemblies, the customer is only required to replace the switching chamber inserts that incorporate the moveable switching pieces and the plastic carrier part.

In a particularly advantageous embodiment of the invention, the plastic carrier part is configured with two mutually parallel sides, which are interconnected via a first further side. In combination, these three sides are arranged in a U-shaped configuration, which permits the accommodation of the stationary switching piece. To this end, the stationary switching piece preferably shows a U-shaped configuration, with two arms and a connecting central element. Structural provision is made to the effect that one arm of the stationary switching piece lies in contact with the first connecting side.

It may also be provided that, at a distance from and parallel to the first connecting side, a second connecting side is arranged such that, between the first and second connecting sides, a recess is formed, into which one arm of the U-shaped stationary switching piece may be inserted. The first connecting side and the second connecting side, arranged above the latter, form a guide slot, into which one arm of the U-shaped stationary contact piece can be inserted.

In a specific embodiment of the invention, mutually parallel recesses for the accommodation of arc splitters are configured on the mutually parallel sides. The integration of various functions in the plastic carrier part permits this component to be used in a wide range of applications such that, even in the event of higher rated currents and higher rated service voltages associated with the interruption of currents in a switching device, an arc extinguisher can be fitted on the plastic carrier part.

In a further specific embodiment of the invention, two mutually parallel guide slots for the accommodation of an arc quenching bucket are arranged on the mutually parallel sides. These accommodators are also configured such that the plastic carrier part will be compatible with higher rated service currents and higher rated service voltages.

In a particularly preferred embodiment of the invention, the plastic carrier part is manufactured from a high-temperature thermoplastic material.

In a specific embodiment of the invention, the plastic carrier part is manufactured from Duroplast.

The abovementioned combination of characteristics may be specifically applied in a contactor. However, it is also conceivable that the present invention, specifically in its preferred configuration, might be used as a power circuit-breaker. The present invention can also be configured as a compact motor feeder.

The switching device in accordance with the invention is provided with a switching chamber, in which stationary switching pieces are arranged opposite moveable switching pieces. Each of the stationary switching pieces is arranged in the plastic carrier part. Lateral connecting terminal blocks may be arranged on the switching device. The switching chamber is covered by a switching chamber cover. In order to replace the exchangeable switching piece assembly, the switching chamber cover is removed, the switching piece assembly is withdrawn, either to the right or to the left, and is replaced.

The positioning of the plastic carrier parts in the switching device is preferably achieved via a guide rail and groove arrangement. It is also possible for the moveable switching pieces to likewise be fitted in a contact carrier, and likewise replaced accordingly.

The plastic carrier part in accordance with the invention is preferably configured with two mutually parallel sides, which are interconnected via a first further side. A second connecting side is preferably arranged at a distance from and parallel to the first connecting side such that, between the first and second connecting sides, a recess is formed, into which one arm of a U-shaped stationary switching piece may be inserted.

Preferably, mutually parallel recesses for the accommodation of arc splitters are configured on the mutually parallel sides. Moreover, mutually parallel guide slots for the accommodation of an arc quenching bucket may also be arranged on the mutually parallel sides. The plastic carrier part in accordance with the invention is preferably manufactured from a high-temperature thermoplastic material. Specifically, the plastic carrier part may be manufactured from Duroplast.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further advantages and embodiments of the invention are described hereinafter with reference to exemplary embodiments and with reference to the drawings, in which.

DETAILED DESCRIPTION OF THE EXEMPLARY EMBODIMENTS

Figure 1:
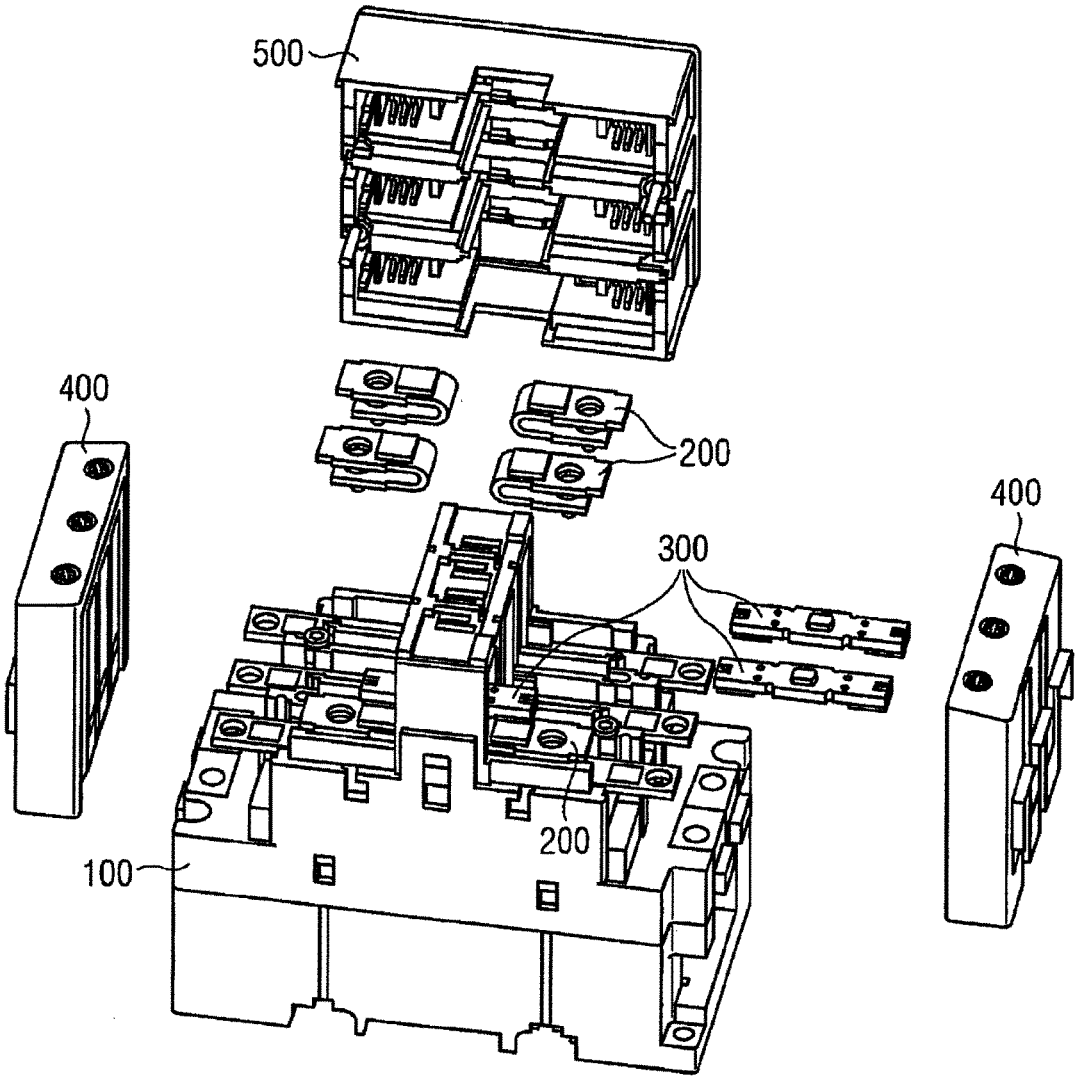
FIG 1 Prior art
FIG. 1 shows a perspective representation of a prior art switching device, with a switching chamber, in which stationary switching pieces and moveable switching pieces arranged in opposition thereto are arranged.

FIG. 1 represents a conventional switching device, with a switching chamber 100, in which stationary switching pieces 200 are arranged opposite moveable switching pieces 300. Lateral connecting terminal blocks 400 are arranged on the switching device. The switching device is covered by an arcing chamber 500. The switching chamber walls, which were also affected by the switching arc, are accommodated in the arcing chamber 500, which must also be replaced when the switching pieces are replaced.

Figure 2:
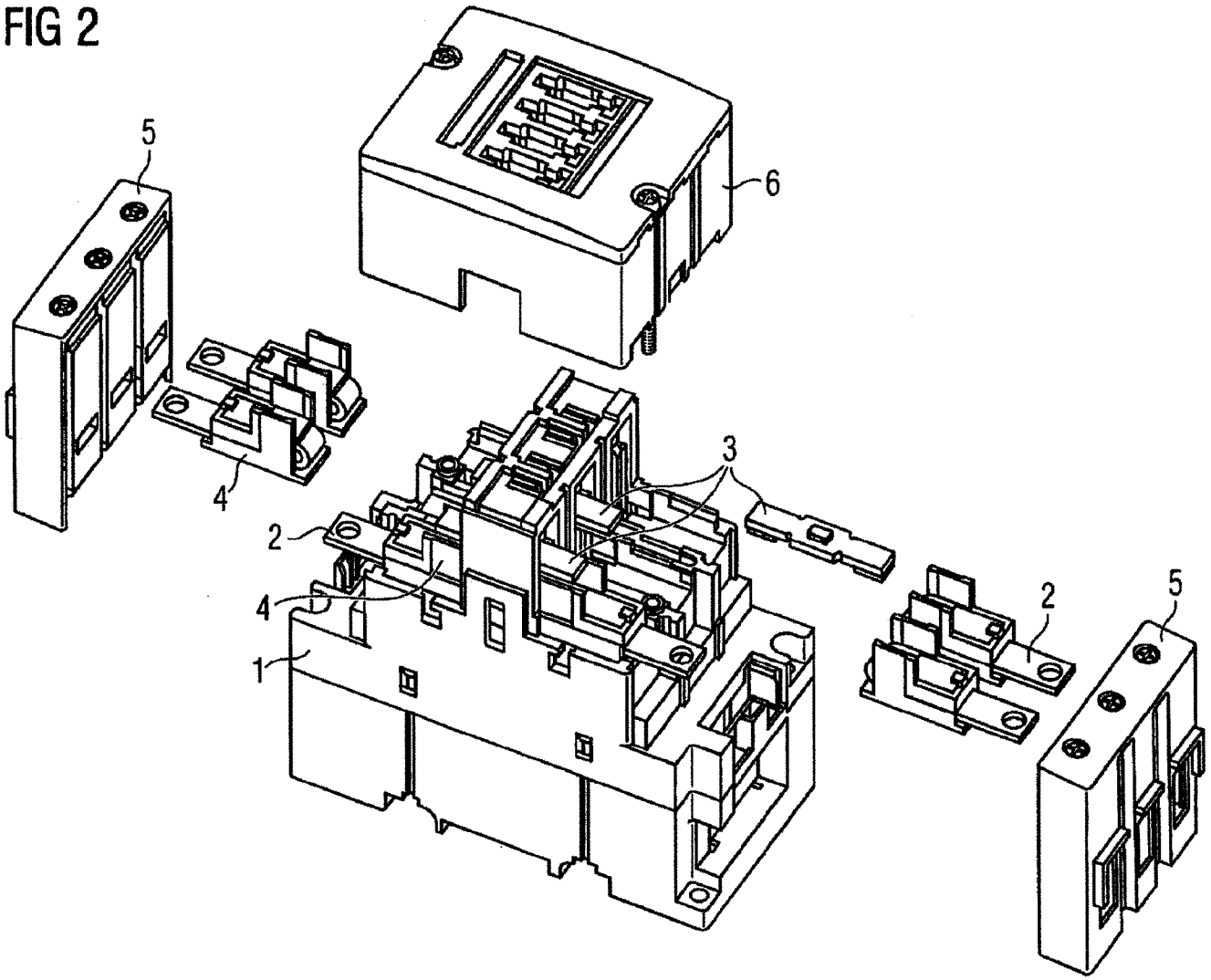
FIG. 2 shows a perspective representation of a switching device in accordance with the invention, with exchangeable switching piece assemblies.

FIG. 2 shows a switching device in accordance with the invention, provided with a switching chamber 1, in which stationary switching pieces 2 are arranged opposite moveable switching pieces 3. Each of the stationary switching pieces 2 is arranged in plastic carrier parts 4. Lateral connecting terminal blocks 5 may be arranged on the switching device. The switching chamber 1 is covered by a switching chamber cover 6. In order to replace the exchangeable switching piece assembly, the switching chamber cover 6 is removed, the switching piece assembly is withdrawn, either to the right or to the left, and is replaced. The positioning of the plastic carrier parts 4 in the switching device is preferably achieved via a guide rail and groove arrangement. It is also possible for the moveable switching pieces 3 to likewise be fitted in a contact carrier, and likewise replaced accordingly.

Figure 3:
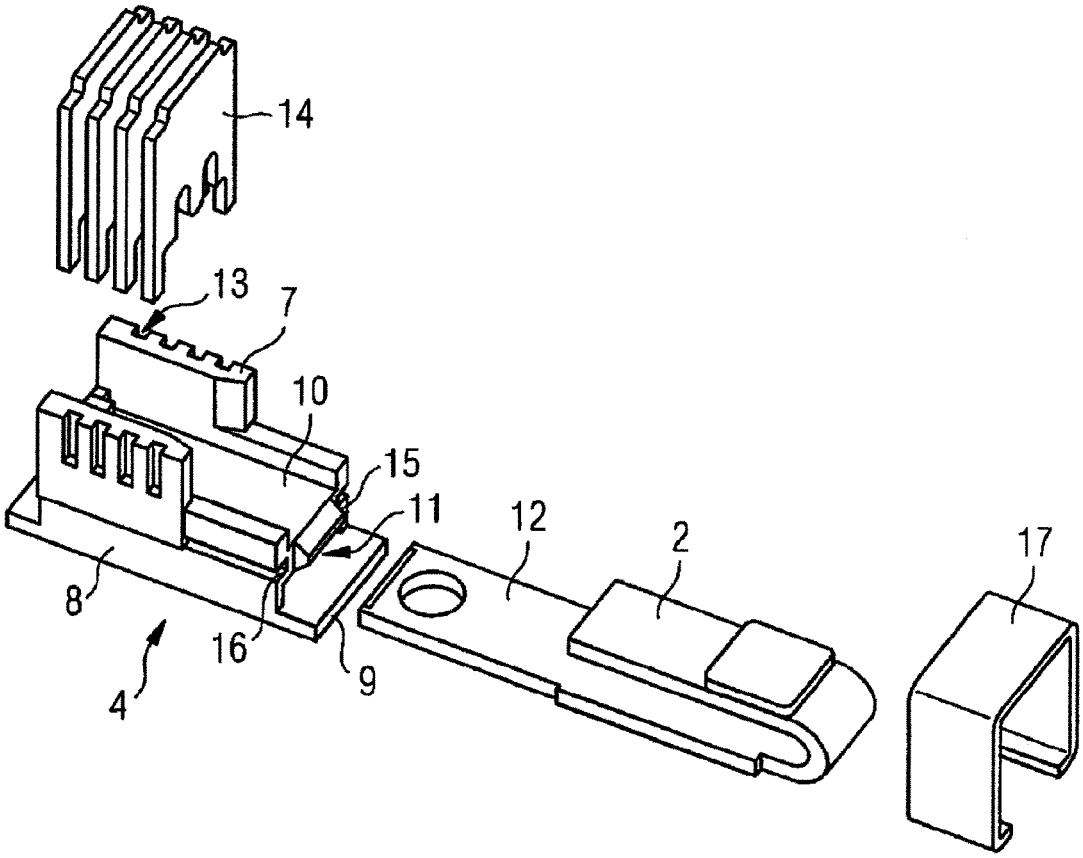
FIG. 3 shows an exploded perspective representation of a switching piece assembly in accordance with the invention.

FIG. 3 represents the individual components of a switching piece assembly in accordance with the invention. The switching piece assembly in accordance with the invention is provided with a plastic carrier 4, which is preferably configured with two mutually parallel sides 7, 8, which are interconnected by a first further side 9. A second connecting side 10 is arranged at a distance from and parallel to the first connecting side 9 such that, between the first and second connecting sides 9, 10, a recess 11 is formed, into which one arm 12 of a U-shaped stationary switching piece 2 may be inserted. Preferably, mutually parallel recesses 13 for the accommodation of arc splitters 14 are configured on the mutually parallel sides 7, 8. Moreover, two mutually parallel guide slots 15, 16 for the accommodation of an arc quenching bucket 17 may be arranged on the mutually parallel sides 7, 8 of the plastic carrier 4.

Figure 4:
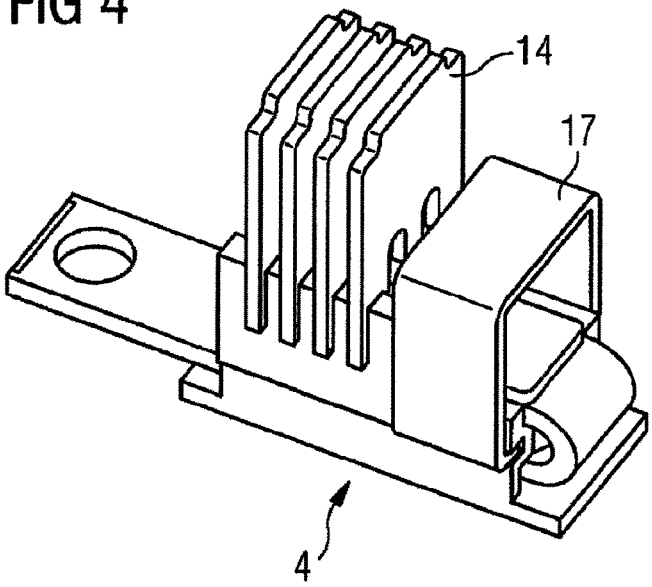
FIG. 4 shows a perspective representation of an assembled switching piece assembly in accordance with the invention.

FIG. 4 shows the assembled switching piece assembly in accordance with the invention, with the arc splitters 14 fitted and the arc quenching bucket 17 in position.

The switching device with exchangeable switching piece assemblies according to the invention is characterized by ease of handling during exchange operations, and also permits the adoption of a compact structure.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A switching device comprising:

a switching chamber;

a movable switching piece;

a stationary switching piece arranged in the switching chamber and opposite the moveable switching piece; and a plastic carrier part having mutually parallel recesses arranged on mutually parallel sides and externally disposed along a longitudinal edge of said mutually parallel sides, said mutually parallel recesses accommodating arc splitters, and the stationary switching piece being fitted to the plastic carrier part;

wherein a component combination of the stationary switching piece when fitted to the plastic carrier part comprises an exchangeable switching piece assembly.

2. The switching device as claimed in claim 1, wherein the plastic carrier part includes two mutually parallel sides, which are interconnected by a first connecting side.

3. The switching device as claimed in claim 2, further comprising:

a second connecting side arranged at a distance from and parallel to the first connecting side such that, between the first and second connecting sides, a recess is formed, into which one arm of a U-shaped stationary switching piece is inserted.

4. The switching device as claimed in claim 1, further comprising:

an arc quenching bucket; and two mutually parallel guide slots arranged on the mutually parallel sides for accommodating the arc quenching bucket.

5. The switching device as claimed in claim 1, wherein the plastic carrier part is manufactured from a high-temperature thermoplastic material.

6. The switching device as claimed in claim 1, wherein the plastic carrier part is manufactured from Duroplast.

7. The switching device as claimed in claim 1, wherein the switching device is a contactor.

8. The switching device as claimed in one of claim 1, wherein the switching device is a power circuit-breaker.

9. The switching device as claimed in one of claims 1 wherein the switching device is a compact motor feeder.

* * * * *